United States Patent [19]

Cantrell et al.

[11] Patent Number: 4,542,754

[45] Date of Patent: Sep. 24, 1985

[54] FILTERED CIGARETTE

[75] Inventors: Daniel V. Cantrell, Prospect; Robert R. Johnson, Louisville, both of Ky.

[73] Assignee: Brown & Williamson Tobacco Corporation, Louisville, Ky.

[21] Appl. No.: 558,220

[22] Filed: Dec. 5, 1983

[51] Int. Cl.[4] ..... A24D 3/04

[52] U.S. Cl. ..... 131/336

[58] Field of Search ..... 131/336, 339, 340, 361

[56] References Cited

U.S. PATENT DOCUMENTS 3,490,461 1/1970 Osmalov et al. ..... 131/336

*Primary Examiner*—V. Millin

*Attorney, Agent, or Firm*—Charles G. Lamb

[57] ABSTRACT

A smoking article, such as a cigarette, includes generally cylindrically shaped, hollow tubular section located in coaxial abutment to one end of the tobacco column of the cigarette and a generally cylindrically shaped filter rod located in coaxial abutment with the tubular section. The wall of the tubular section is fabricated of an impermeable material. A plurality of grooves are formed in the periphery of the tubular section extending generally longitudinally thereof and being open to at least one end of the tubular section. Air permeable tipping material circumferentially surrounds the tubular section and the filter rod, and overlaps a portion of the tobacco column adjacent to the tubular section to fasten the tubular section and filter rod to the tobacco column.

11 Claims, 4 Drawing Figures

FILTERED CIGARETTE

BACKGROUND OF THE INVENTION

1. Field of the Invention

The present invention relates to smoke diluting devices, and more particularly to a mouthpiece for a cigarette, or the like, which reduces tar almost exclusively by ventilation.

2. Description of the Prior Art

It is well known in the art to add filters to cigarettes wherein the filters are provided with ventilating means to bring ambient air into the filter to dilute the smoke flowing through the filter. The dilution of the smoke reduces the quantity of smoke particulates as well as gas phase components which are delivered to the mouth of the smoker.

Another method for diluting the smoke is to make the tobacco column wrapper material permeable to air which allows for the introduction of air along the entire length of the tobacco column where it mixes with the smoke stream passing through the tobacco column thereby diluting the smoke.

Yet another method is to provide generally longitudinal ventilation air grooves in the periphery of a filter which grooves are open to the mouth end of the filter. The filtered smoke leaving the mouth end of the filter is mixed with the ventilation air exiting the ventilation air grooves in the smoker's mouth whereat the smoke is diluted. Examples of cigarette filters having grooves for the introduction of ventilating air into the filtering end are shown in the following patents: U.S. Pat. No. 3,577,995; U.S. Pat. No. 3,572,347; U.S. Pat. No. 3,490,461; U.S. Pat. No. 1,718,122; U.S. Pat. No. 3,788,330; U.S. Pat. No. 3,773,053; U.S. Pat. No. 3,752,165; U.S. Pat. No. 3,638,661; U.S. Pat. No. 3,608,561; U.S. Pat. No. 3,910,288; and U.S. Pat. No. 4,256,122.

It has also been proposed to provide a cigarette filter which delivers a combination of air diluted filtered smoke and undiluted, unfiltered smoke to the smoker's mouth. One such cigarette filter is shown in U.S. Pat. No. 3,860,011 as being formed of a hollow filter including a rigid non-deformable tube defining a smoke passage for delivering unfiltered smoke to the smoker's mouth, a concentric layer of filter material surrounding the tube, and a perforated outer wrap for the passage of air into the layer of filter material.

Devices for diluting unfiltered smoke with ventilating air before the smoke enters a smoker's mouth are also known. One example of such a device is shown in U.S. Pat. No. 3,552,399. The device, therein referred to as a filter for homogenizing air and smoke has a blind ended, longitudinal central axial passageway open to either the smoker's mouth or a filter element, a plurality of longitudinal passageways surrounding and extending parallel to the central passageway, and transverse passageways interconnecting the longitudinal passageways and central passageway with each other and with the ambient air. As the cigarette to which the device is smoked, smoke and ambient air traverses the longitudinal and central passageways wherein the smoke and air are mixed before delivery to the smoker's mouth.

Devices are also known for delivering unfiltered smoke and ventilation air to the smoker's mouth. For example, U.S. Pat. No. 4,023,576 teaches a cigarette with a hollow mouthpiece which defines a smoke chamber. The smoke chamber is separated from the tobacco column by two spaced apart baffle plates which define a curved path which the smoke must traverse before entering the smoke chamber. The mouth end of the chamber is closed by a wall having a central orifice for the flow of smoke out of the smoke chamber into the smoker's mouth. The exterior surface of the mouthpiece is provided with longitudinal grooves which cooperate with an overlaying perforated tipping paper to define flow paths for ventilating air. When a smoker draws on the mouthpiece, undiluted, unfiltered smoke is drawn from the tobacco column into the smoke chamber and through the outlet orifice centrally of the mouthpiece and into the smoker's mouth. At the same time, ventilation air is drawn in through the tipping paper and longitudinal grooves to mix with the undiluted smoke within the smoker's mouth.

SUMMARY OF THE INVENTION

The present invention advantageously provides a straightforward arrangement of a hollow tubular section and filter for a cigarette for lowering tar primarily by ventilation using embient air. The present invention also provides for lowering tar by ventilation in conjunction with gas separation.

More particularly, the present invention provides a cigarette comprising a generally cylindrically shaped tobacco column; a generally cylindrically shaped, hollow tubular section located in coaxial abutment to one end of the tobacco column, the wall of the tubular section being impermeable; a plurality of grooves formed in the periphery of the tubular section extending generally longitudinally of the tubular section and being open to at least one end of the tubular section; a generally cylindrically shaped filter rod located in coaxial abutment with the tubular section at the end thereof to which the grooves are open; and tipping material circumferentially surrounding the tubular section and the filter rod, and overlapping a portion of the tobacco column adjacent the tubular section, the tipping material being permeable.

BRIEF DESCRIPTION OF THE DRAWINGS

The various features and advantages of the present invention will become even more clear upon reference to the following description and accompanying drawings wherein like numerals refer to like parts throughout, and in which.

DESCRIPTION OF THE PREFERRED EMBODIMENTS

Figure 1:
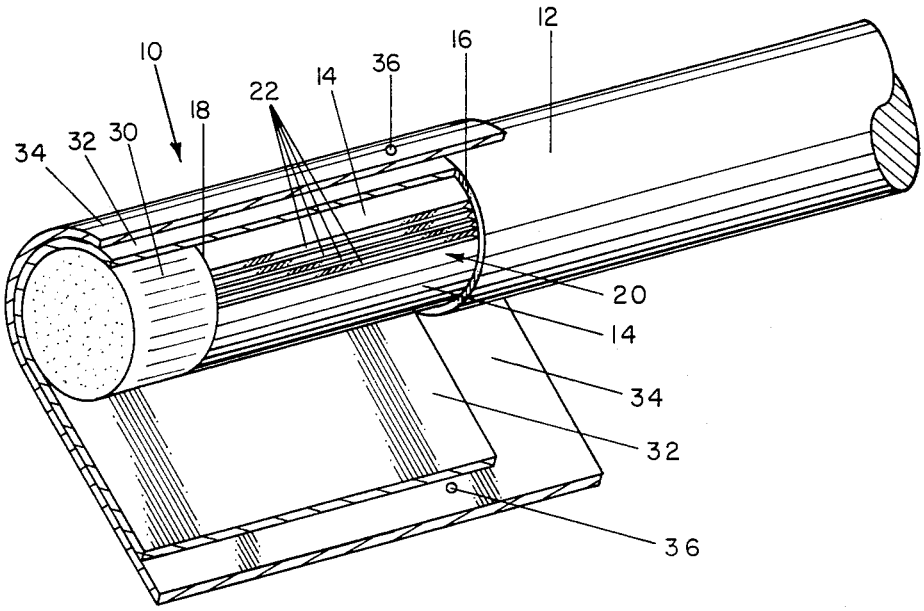
FIG. 1 is a perspective view of a cigarette including an embodiment of the present invention, the tipping material being illustrated as being partially unwrapped to more clearly show details.

FIG. 1 shows a mouthpiece of the present invention, generally denoted as the numeral 10, attached to a cigarette tobacco column 12.

Figure 2:
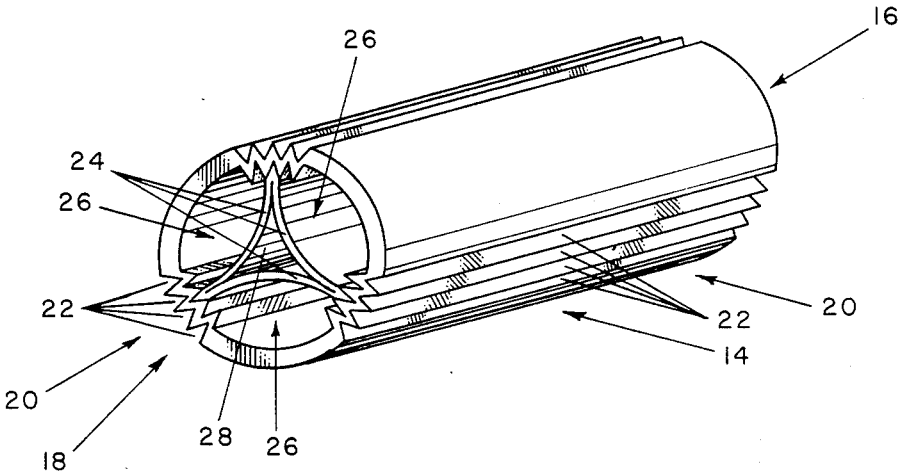
FIG. 2 is a perspective view of a component of the cigarette of FIG. 1.

With continued reference to FIG. 1 and additional reference to FIG. 2, the mouthpiece 10 is shown as including a generally cylindrically shaped, hollow tubular section 14 having a smoke inlet end 16 and a smoke outlet end 18. The cylindrical section 14 is fabricated of a smoke and air impermeable material such as, for example, an extruded plastic. The tubular section 14 is coaxially located to one end of the tobacco column 12 with its inlet end 16 in juxtaposition to the end of the tobacco column 12. The tubular section 14 is formed with a plurality of groups 20 of grooves 22 in its peripheral surface. Each group 20 includes a plurality of grooves 22 extending generally longitudinally of the tubular section 14 from the inlet end 16 to the outlet end 18. As illustrated, there are three groups 20 of grooves 22 equally spaced apart around the circumference of the tubular section 14, and each group 20 is made up of four grooves 22 located immediately adjacent and in parallel disposition to each other. The tubular section 14 includes webs 24 each spanning, generally, a different chord of the transverse cross-section of the tubular section 14 and extending the entire length of the tubular section 14. As shown, there are three such webs 24 spaced at equal intervals around the interior of the tubular member 14. The webs 24 cooperate with the interior wall surface of the tubular member 14 to define three smoke flow channels 26 which are open to both ends 16 and 18 of the tubular section 14. In addition, the webs 24 mutually cooperate to define a central smoke channel 28 coaxial with the longitudinal centerline of the tubular section 14 and open to both ends 16 and 18 of the tubular section 14.

With reference to FIG. 1, the mouthpiece 10 further includes a low efficiency filter rod 30 of generally cylindrical configuration having generally the same diameter as the tubular section 14. The filter rod 30 is coaxially located with the tubular section 14 and is in juxtaposition to the outlet end 18 of the tubular section 14. The filter rod 30 can be fabricated of various materials such as, for example, fiberous or open cell foamed cellulose acetate.

A layer of air permeable wrap 32 circumscribes the filter rod 30 and the tubular section 14 holding the filter rod 30 and tubular section 14 together. The mouthpiece 10 is shown as being attached to the tobacco column 12 by an air permeable tipping material 34 which circumscribes the mouthpiece 10 and overlaps a portion of the tobacco column 12 adjacent to the inlet end 16 of the tubular section 14 of the mouthpiece. At least a portion of the tipping material 34 surrounding the tubular section 14 is air permeable over the grooves 22 to provide for the flow of ambient air into the grooves 22. The tipping material 34 can be fabricated of a porous material or, as shown, the air permeability can be provided by forming small perforations 36 through the thickness of the tipping material 34.

Figure 3:
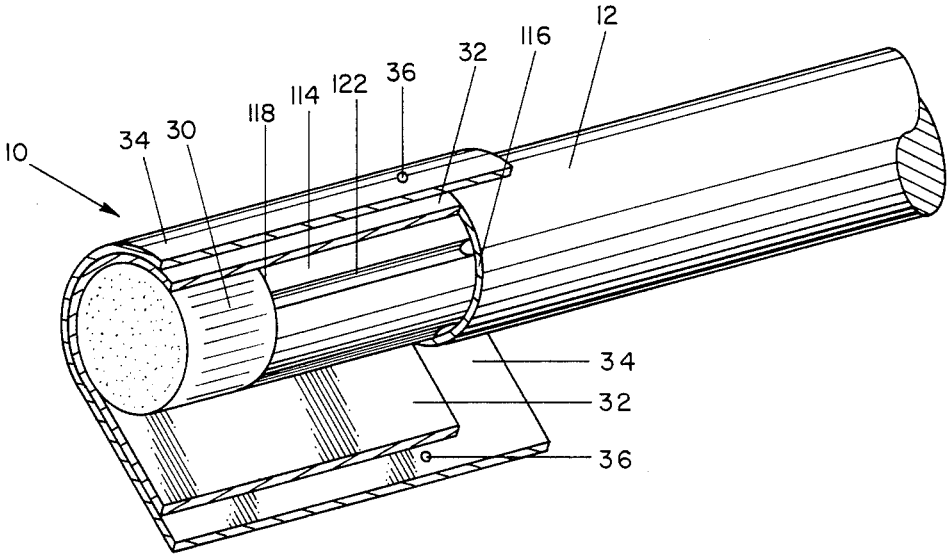
FIG. 3 is a perspective view of a cigarette including another embodiment of the present invention, the tipping material being illustrated as being partially unwrapped to more clearly show details; and, FIG. 4 is a perspective view of a component of the cigarette of FIG. 3.

FIG. 3 shows another advantageous embodiment of a mouthpiece of the present invention, generally denoted as the numeral 110, attached to the cigarette tobacco column 12.

Figure 4:
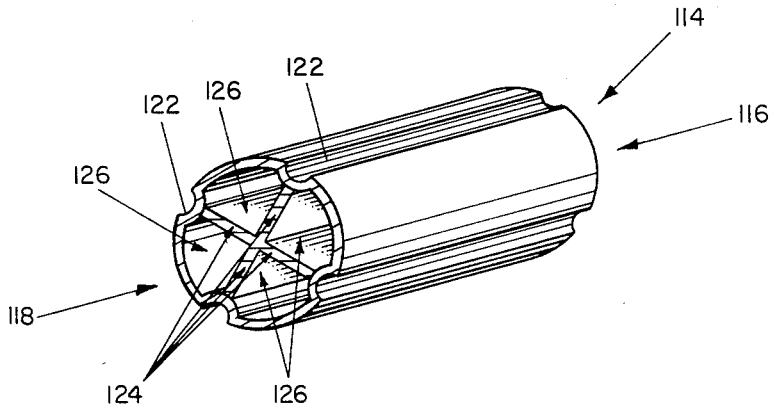

With continued reference to FIGS. 1 and 3 and additional reference to FIG. 4, the mouthpiece 110 includes a generally cylindrically shaped, hollow tubular section 114 having a smoke inlet end 116 and outlet end 118. The tubular section 114 is fabricated of a smoke and air impermeable material such as, for example, extruded plastic. The tubular section 114 is coaxially located at one end of the tobacco column 12 with its inlet end 116 in juxtaposition to the end of the tobacco column 12. The tubular section 114 is formed with a plurality of grooves 122 in its peripheral surface extending generally longitudinally of the tubular section 114 the inlet end 116 to the outlet end 118 of the tubular section 114. The grooves 122 are shown as being four in number equally spaced apart about the circumference of the tubular section 114. The tubular section 114 includes webs 124 equal in number to the number of grooves 122. As illustrated in FIG. 4, each of the webs 124 extends from a different one of the grooves 122 generally radially of the transverse cross-section of the tubular section 114 and join together at the longitudinal centerline of the tubular section 114. The webs 124 also extend the entire length of the tubular section 114. The webs 124 cooperate with the interior wall surface of the tubular section 114 to define four smoke flow channels 126 which are open to both ends 116 and 118 of the tubular section 114.

As with the mouthpiece 10 of FIG. 1, the mouthpiece 110 also includes the low efficiency filter rod 30 in coaxial juxtaposition to the outlet end 118 of the tubular section 114. The filter plug 30 is held in position with the tubular section 114 by the circumscribing air permeable wrapper 32, and the mouthpiece 110 is attached to the tobacco column 12 by the air permeable tipping material 34 as fully discussed in regard to the mouthpiece 10.

As the smoker draws on the cigarette unfiltered smoke passes through the channels of the tubular section to the filter rod and substantially only ambient ventilating air is drawn into the grooves and passes through the grooves to the filter rod.

The foregoing detailed description is given primarily for clearness of understanding and no unnecessary limitations should be understood therefrom for modifications will become obvious to those skilled in the art upon reading this disclosure and may be made without departing from the spirit of the invention or scope of the appended claims.

What is claimed is:

1. A cigarette comprising:

a generally cylindrically shaped tobacco column;

a generally cylindrically shaped hollow tubular section located in coaxial abutment to one end of the tobacco column, the wall of the tubular section being impermeable;

a plurality of grooves formed in the periphery of the tubular section extending generally longitudinally of the tubular section and being open to at least one end of the tubular section;

a generally cylindrically shaped filter rod located in coaxial abutment with the tubular section in gas flow communication with the grooves of the tubular section; and, tipping material circumferentially surrounding the tubular section and the filter rod, and overlapping a portion of the tobacco column adjacent the tubular section, the tipping material being permeable.

2. The cigarette of claim 1, wherein the tubular section has an outside diameter generally equal to the diameter of the tobacco column.

3. The cigarette of claim 2, wherein the filter rod has a diameter generally equal to the diameter of the tubular section.

4. The cigarette of claim 1, further comprising permeable wrapper material circumferentially surrounding the tubular section and the filter rod, the tipping material overlaying the wrapper material.

5. The cigarette of claim 1, wherein the tipping material is permeable at least in an area overlaying the grooves of the tubular section.

6. The cigarette of claim 1, wherein the grooves are generally equally spaced apart circumferentially of the tubular section.

7. The cigarette of claim 1, wherein the grooves are organized into a plurality of groups, each group including a plurality of grooves.

8. The cigarette of claim 7, wherein the groups are generally equally spaced apart circumferentially of the tubular section.

9. The cigarette of claim 1, further comprising webs located within the hollow interior of the tubular section.

10. The cigarette of claim 9, wherein the webs extend the entire length of the tubular section.

11. The cigarette of claim 10, wherein the webs divide the interior of the tubular section into a plurality of smoke flow channels.

* * * * *